US007014531B2

(12) United States Patent
Hansen

(10) Patent No.: US 7,014,531 B2
(45) Date of Patent: Mar. 21, 2006

(54) METHOD AND APPARATUS FOR INLINE MEASUREMENT OF MATERIAL REMOVAL DURING A POLISHING OR GRINDING PROCESS

(75) Inventor: Jesper Rømer Hansen, Frederiksberg (DK)

(73) Assignee: Struers A/S, Ballerup (DK)

( * ) Notice: Subject to any disclaimer, the term of this patent is extended or adjusted under 35 U.S.C. 154(b) by 0 days.

(21) Appl. No.: 10/807,401

(22) Filed: Mar. 24, 2004

(65) Prior Publication Data

US 2004/0229546 A1 Nov. 18, 2004

Related U.S. Application Data

(63) Continuation-in-part of application No. PCT/DK02/00610, filed on Sep. 20, 2002.

(30) Foreign Application Priority Data

Sep. 24, 2001 (DK) ..... 2001 01391

(51) Int. Cl.
*B25B 49/00* (2006.01)

(52) U.S. Cl. ..... 451/8; 451/5; 451/6; 451/285

(58) Field of Classification Search ..... 451/8, 451/5, 6, 9, 10, 28, 41, 63, 285, 287, 288, 451/289
See application file for complete search history.

(56) References Cited

U.S. PATENT DOCUMENTS 5,741,171 A 4/1998 Sarfaty
5,816,899 A 10/1998 Hart et al.
5,948,203 A 9/1999 Wang
5,964,643 A 10/1999 Birang et al.
6,071,177 A 6/2000 Lin et al.
6,095,905 A * 8/2000 Jameson ..... 451/41
6,208,425 B1 3/2001 Sandhu et al.
6,213,844 B1 * 4/2001 Lenkersdorfer ..... 451/6
6,273,792 B1 * 8/2001 Meloni ..... 451/41
6,439,979 B1 * 8/2002 Beppu et al. ..... 451/285
6,524,165 B1 * 2/2003 Wiswesser et al. ..... 451/6
6,707,540 B1 * 3/2004 Lehman et al. ..... 356/72
2001/0023167 A1 9/2001 Kimura et al.

FOREIGN PATENT DOCUMENTS

WO 9619318 6/1996

* cited by examiner

*Primary Examiner*—Joseph J. Hail, III
*Assistant Examiner*—Alvin J. Grant
(74) *Attorney, Agent, or Firm*—Dykema Gossett PLLC

(57) ABSTRACT

Apparatus for inline measurement of material removal during a polishing or grinding process including:

a. a substantially circular rotatable grinding or polishing pad; and
b. a sample holder; and
c. a sample with a top, a bottom and one or more side surfaces;

the sample holder being arranged to hold the bottom surface of the sample in contact with the pad and the sample holder being connected to a moving device to move the sample to a position at least partially over the rim of the pad, during at least a part of the process, the apparatus also including a detecting device for sampling the distances between a reference mark and a target area in the sample and a plane defined by the bottom surface of the sample during the process.

27 Claims, 9 Drawing Sheets

METHOD AND APPARATUS FOR INLINE MEASUREMENT OF MATERIAL REMOVAL DURING A POLISHING OR GRINDING PROCESS

CROSS REFERENCE TO RELATED APPLICATION

This application is a continuation-in-part of PCT/DK02/00610, filed 20 Sep. 2002, the priority of which is claimed.

FIELD OF THE INVENTION

The invention relates to materialographic grinders and polishers and more particularly to inline measurement of material removal on rotary grinders or polishers for preparation of samples to micron or submicron precision. Inline measurement means that the measurement is performed during/simultaneously with the grinding or polishing process.

BACKGROUND OF THE INVENTION

Materialographic grinders and polishers are used intensively for preparation of raw material and for preparation of samples to microstructural analysis. For example submicron precision polishing is used for preparation of silicon wafers which are useful for chip fabrication. Automated grinding is widely used as a shaping process of solid materials, for example for final shaping of sintered advanced ceramic components and various metallic precision parts. Polishing and grinding are also used in quality control and failure analysis for materialographic examination. In all these cases fast, reliable, automated inline measurement of material removal is essential for the end user.

STATE OF THE ART

The grinding and polishing process takes place on a rotary grinding or polishing apparatus. A micrometer screw as described in U.S. Pat. No. 5,816,899, Hart et al, may control the material removal. However, this technique is limited by the precision of the mechanical set-up and the flexibility of the polishing pad. Manual adjustment of polishing zero point and careful near-target polishing is hence required. The sample is typically only accessible for inspection from the top during preparation. Hence, to investigate the status of the polishing process it is required to remove the sample from the equipment and inspect the surface to be polished by microscope. The microscope may be built into the polishing apparatus, but the investigation is manual and time consuming.

The inspection may be semi-automatic by use of for example video microscope and image recognition (U.S. Pat. No. 5,741,171, Sarfaty et al.). However, the measuring system needs to be manually set up for each type of sample and the polishing speed is limited.

The removal rate during the polishing may be inspected inline as disclosed by Pyatigorsky et al. in U.S. Pat. No. 5,964,643. Here, the sample is inspected by a laser interferometer through the polishing pad. This requires specially prepared polishing pads and is rather complicated to control.

Lenkersdorfer (U.S. Pat. No. 6,213,844) discloses a system where the film thickness on a wafer is measured when the wafer is over the rim of the polishing pad. Even though this is an automatic system it is not intended for inline measurement but rather for checking the status of the polishing after a time controlled polishing process. The system disclosed in U.S. Pat. No. 6,213,844 has the drawback compared to the present invention that the inspection of the surface is from beneath the sample which leads to concerns on how to keep the measurement system tidy during measurement. Furthermore, the measurement system uses diffraction of white light for the determination of the film thickness, which is not suitable for non-transparent materials.

Another way of measuring the material removal is to follow the vertical displacement of the polishing head during the polishing. This may for example be done by a linear variable differential transformer or by a laser displacement sensor. To realise high precision the system must be highly mechanically stiff, which is expensive and difficult to achieve for lab-size equipment. Otherwise the vibration of the polishing system during operation together with the flexibility of the polishing pad reduces the precision of these methods.

Consequently there is a need for a method and an apparatus which can be used for measurements on a sample during a grinding or polishing process, and which method and apparatus are easy in use and able to make measurement of removal of material with high precision.

The object of the present invention is to provide a system for inline measuring material removal during a grinding or polishing process.

A second object of the present invention is to provide a system for measuring material removal which is less sensitive to mechanical vibration of the grinding or polishing system than the prior art techniques.

A third object of the present invention is to provide a system for measuring material removal which is less complicated than the prior art techniques to operate and adjust when changing sample.

Yet another object of the present invention is to provide a method for using an inline material removal device as part of the equipment for preparation of materialographic samples.

Moreover it is an object of the present invention to provide an apparatus in which contamination of the measurement system with material from the sample is significantly reduced.

SUMMARY OF THE INVENTION

The present invention provides a system for inline measurement of material removal automatically without interference from vibration of the grinder or polisher. Basically, to perform such a measurement access is needed to a well-defined bottom surface of the sample where the polishing action takes place, and a well-defined reference mark preferably on either the sample or the sample holder. Furthermore, the frequency of measurement of the relative position of these two points must be much higher than the vibration of the equipment. This is achieved by sweeping the sample to pass over the rim of the grinding/polishing pad, thereby allowing access to both the top and bottom of the sample. This method will yield a perfect result despite misalignment of the sample during mounting.

In one aspect the present invention relates to an apparatus for inline measurement of material removal during polishing or grinding of a specimen. Such an apparatus comprises

- a circular rotatable grinding or polishing pad;
- a sample holder
- a sample or specimen with a top surface, a bottom surface and one or more side surfaces. Normally the sample has a shape of a cylinder with a circular cross section and thereby having one side surface. Alternatively the sample may have a triangular or quadrangular, etc., cross section and thereby having three or more side surfaces. Preferably the top surface and the bottom surface are planar.

In the apparatus according to the invention the sample holder is arranged to hold the bottom surface of the sample in contact with the grinding or polishing pad and preferably the sample holder is connected to a moving device which during the grinding or polishing process moves or slides the sample to a position at least partially over the rim of the grinding or polishing pad. The moving device preferably is an arm in connection with a mechanism and driving aggregate e.g. an electro motor, which will cause the arm to move. Moreover the apparatus comprises a detecting device for sampling the distances between a reference mark and a target area in the sample and a plane defined by the bottom surface of the sample during the grinding or polishing process and at the position where the sample is at least partially over the rim of the grinding or polishing pad. The detecting device is connected to a device for storing and/or comparing said distances, and the detecting device sends the sampled distances to be stored and or compared in the device for storing and/or comparing.

The sample should be partially over the rim of the polishing or grinding pad during some or all of the time of the polishing or grinding process and in particular while the distance between the bottom surface of the sample is polished and the reference mark is measured. When this distance is monitored over time, the material removal may be extracted. It is also useful to utilize the information of the distance between the bottom surface of the sample which is polished and the reference mark as compared with a distance between the reference mark and a target area for controlling the endpoint of the polishing or grinding.

In the apparatus according to the invention it is preferred that the reference mark is constituted by a point, a line substantially parallel to the surface of the grinding or polishing pad, an orifice substantially parallel to the surface of the grinding or polishing pad, a plane substantially parallel to the surface of the grinding or polishing pad. Preferably the reference mark is placed on or in connection with the sample and/or the sample holder.

In a preferred embodiment of the apparatus according to the invention the target area is constituted by a plane, a line or a spot/mark/point.

In a preferred embodiment of the apparatus according to the invention the detecting device used to detect the distance between the reference mark and the plane defined by the bottom surface of the sample is a scanning laser micrometer or alternatively a combination of two laser displacement sensors.

The size of the sample or specimen may vary considerably. Typically, the specimens have a circular cross section but any geometry may be used as long as the part of the specimen constituting the bottom surface and used for the measurement of the aforementioned distance has sufficient size for the measurement to be made. The specimen should preferably be at least approx. 1 cm over the rim of the polishing or grinding pad when the measurement takes place. However, by carefully positioning the measurement system, smaller amounts or areas of sample can be acceptable.

In order to achieve acceptable measurements it is preferred that the sample diameter is at least 20 mm, preferably 25 to 50 mm, and more preferably 30 to 40 mm.

Very large samples like for example silicon wafers may easily be measured by the system described in this invention.

In a preferred embodiment of the invention the sample holder is highly important for use as reference mark. In this embodiment the sample holder must have a well-defined upper reference plane, edge or point. The geometry of the reference plane depends on the type of sweeping and optional rotation of the sample and/or sample mover. For the preferred embodiment with the scanning laser micrometer the important fact is that when the sample holder is seen from the side it should form a sharp upper line for the measurement of the aforementioned distance.

The material forming the plane used as the reference mark on the sample holder may be made from any hard material such as metal, for example steel, stainless steel, aluminium, hard metal (tungsten carbide), ceramic or plastic. The edge may have been optimized for the purpose by various surface treatments like for example heat treatment, anodisation phosphatation, ion implantation or shot peening.

In a preferred embodiment of the apparatus according to the invention the sample holder comprises a goniometric mechanism for three-dimensional adjustment of the sample prior to the polishing or grinding process.

The apparatus may further comprise a sweeping mechanism to facilitate the use of a larger fraction of the polishing pad as well as reduce the likelihood of half moon formation on the sample. Furthermore, sweeping of the sample leads to a more even scratch pattern on the sample. The sample may be swept along a line for example in radial direction on the polishing or grinding pad or along a fraction of a circular path. Anyway, the sample must pass the rim of the polishing or grinding pad when the aforementioned distance is measured.

Consequently in a preferred embodiment the apparatus comprises a moving device for moving, sliding or sweeping the sample holder over the surface of the grinding or polishing pad. The moving device is connected to the sample holder and capable of moving or sliding the sample holder in a desired pattern, e.g., a radial, a circular, or a rotating pattern. Preferably the moving device is an arm connected to a driving mechanism, e.g., a computer operated electro motor.

More than one sample may be treated simultaneously. In a preferred embodiment of the apparatus the sample holder may hold more than one sample. Any number of samples may be treated simultaneously, but the preferred numbers are 1, 3, 4, 5, 6, 8 or 12 samples at one time.

In a preferred embodiment of the apparatus according to the invention the device for storing and/or comparing the measured or detected distances during the grinding or polishing process is a computer. For the skilled person it is clear that the same computer can be utilized for receiving and storing data from the detecting device, e.g., a scanning laser micrometer, and calculate and compare the data and simultaneously control the entire apparatus or selected functions like for example the moving device or the polishing pad.

The system as described above is preferably used for preparation of materialographic samples. However, the system may also be used for other applications. One important application where the invention is highly useful is preparation of silicon wafers.

Another aspect of the present invention relates to a method of grinding or polishing a sample or silicon wafer on a substantially circular rotating grinding or polishing pad, which method comprises the steps of:

a. selecting an area of interest in the raw material to form the sample or alternatively select a silicon wafer as a sample to be treated
b. optionally resizing the raw material for example by cutting
c. optionally mounting the raw material in a resin and cure the resin to form a sample with a top surface, a bottom surface and at least one side surface, in which said area of interest is substantially within an area near the bottom surface, meaning that the area of interest is substantially congruent with or just below the bottom surface of the sample, preferably the area of interest is 1000–50 $\mu$m below/above the bottom surface of the sample before grinding or polishing
d. placing the sample in a sample holder
e. identifying a reference mark
f. identifying a target area in the sample, which is be the plane or final bottom surface in the sample where you wish to stop the grinding or polishing process
g. aligning the target area in the sample in three dimensions with respect to the reference mark when the area is a plane
h. measuring the reference distance from the target area in the sample to the reference mark and storing the reference distance in a storing device
i. placing the sample holder with the sample on a grinding or polishing pad, with the bottom surface of the sample in contact with the surface of the grinding or polishing pad
j. optionally grinding or polishing the bottom surface of the sample in at least one step removing material in an amount to bring the bottom surface of the sample near to the target area or final bottom surface in the sample
k. grinding or polishing the bottom surface of the sample until the plane defined by the bottom surface is congruent/coincident with the target area while controlling the removal of material by measuring the distance between the plane defined by the bottom surface and the reference mark and comparing the measured distance with the stored reference distance
l. stop the grinding or polishing of the top surface when the distance between the plane defined by the top surface and the reference mark is equal to the stored reference distance.

By use of the method according to the invention it is possible to grind or polish a sample with very high precision.

The target area may be a target plane or a target mark/spot or target line.

The reference mark may also be a plane line or spot.

In a preferred embodiment a planar surface which is substantially parallel to the surface of the grinding or polishing pad is used as reference mark, preferably the planar surface is the upper part of the sample and/or the sample holder. In this embodiment the reference mark can be established in an easy and uncomplicated way.

Preferably more samples are placed in the sample holder and grinded or polished simultaneously. It is preferred that 3 to 12 samples are placed in the sample holder and are treated at the same time in order to save time in the process.

According to the method it is preferred that the distance between the plane defined by the bottom surface and the reference mark is measured at a position where the sample is moved with the sample holder to be at least partly over the rim of the grinding or polishing pad. Hereby the best position for measurement is obtained.

In a preferred embodiment of the method the distance between the plane defined by the bottom surface of the sample and the reference mark is measured with a scanning laser micrometer or a combination of two laser displacement sensors. By use of these sophisticated techniques it is possible to achieve very high precision in the measurement of the distances between the bottom surface and the reference mark during the grinding or polishing process.

Preferably the reference distance is stored and compared to the distance measured between the plane defined by the top surface of the sample and the reference mark in a computer. During the grinding or polishing process material will be removed from the treated bottom surface of the sample, thus the distance between the bottom surface and the reference mark will change during time. A computer can easily register these changed distances and compare them to the reference distance. When the distance between the bottom surface and the reference mark is equal to the reference distance, the computer will stop the grinding or polishing process.

The method is used for grinding or polishing materialographic samples.

Moreover the method according to the invention is used for grinding or polishing silicon wafers.

The invention will now be described in further details with reference to a drawing, which illustrates some embodiments of the invention.

DETAILED DESCRIPTION OF THE PREFERRED EMBODIMENT

Figure 1A:
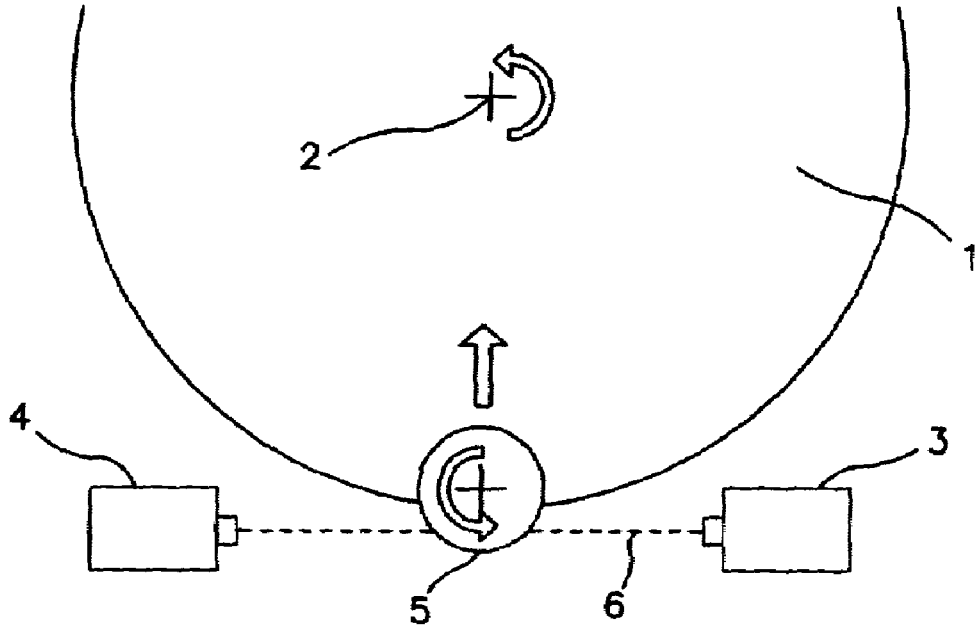
FIG. 1 shows top-view of set-up with single sample holder and radial sweeping.
Figure 1B:
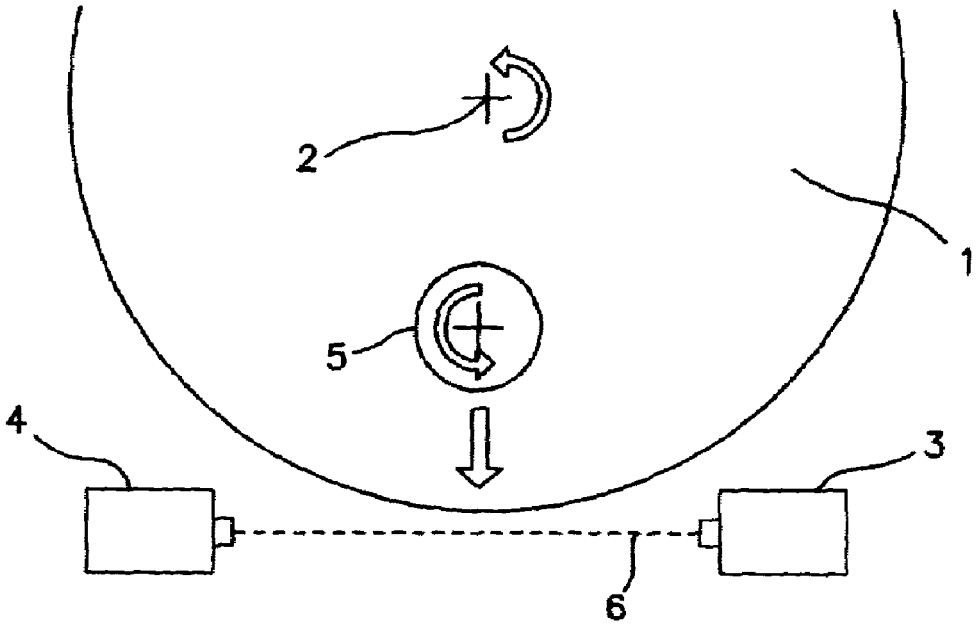

In FIG. 1 a top-view of the set-up with a single sample holder is seen. The sample (5) is swept forward and backwards towards the centre (2) of the polishing or grinding pad (1). In FIG. 1A the sample is passing over the rim of the polishing or grinding pad and the height from the end face of the sample is polished and the reference plane is being measured. The measurement is preferably performed by a laser scanning micrometer, where a band of parallel laser beams (6) is sent from the emitter (3) to the receiver (4). The sample in the sample holder (5) obstructs some of the laser beams in FIG. 1A while in FIG. 1B the sample is completely over the polishing pad. No laser beams are obstructed in FIG. 1B and hence the measurement is in pause mode.

During the polishing or grinding the polishing pad (1) is rotated round its centre (2). The sample is preferably rotated round its vertical centre axis during the grinding or polishing action, however this rotation is not necessary for the material removal measurement to work.

Figure 2:
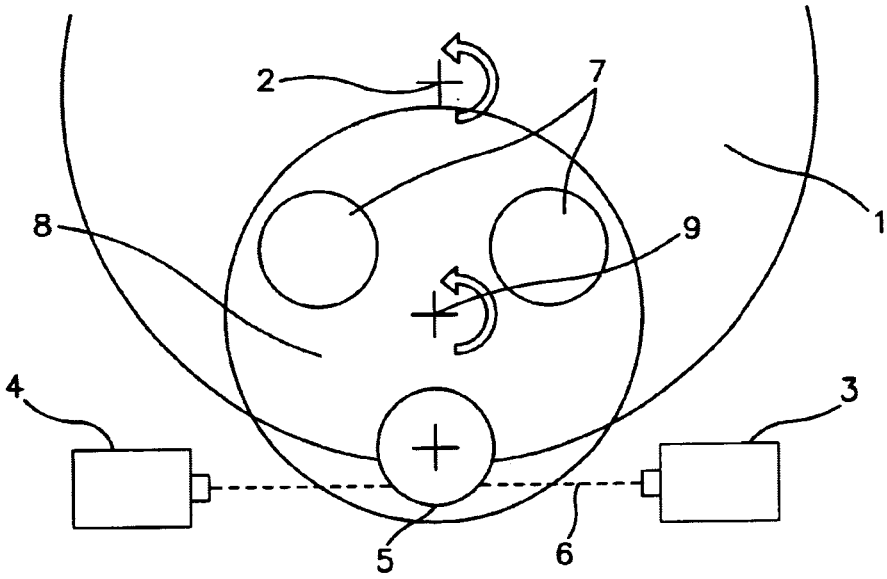
FIG. 2 shows top-view of another embodiment with sample holder with 3 samples or 1 sample and 2 dummies.

FIG. 2 shows the top-view of another embodiment where 3 samples are simultaneously being treated. A moving device (8) with 3 samples is shown.

The samples may be mounted directly in the moving device, whereby the moving device will act as the sample holder. Alternatively, separate sample holders for each sample may be placed in the moving device yielding a system with 3 sample holders. The specimen mover will rotate round its centre (9) during the polishing or grinding. If individual sample holders are used for each sample, these samples may also individually rotate round the sample centre axis.

For high precision preparation it is usually not feasible to mount 3 samples in one sample holder with sufficient precision and one solution is to use 1 sample and 2 dummies (7) for the precision polishing step.

In FIG. 2 simultaneous treatment of 3 samples is shown as an example but the moving device or the sample holder may be designed to other numbers of samples with 3, 4, 6, 8 and 12 being the preferred number of samples. Two samples may be treated simultaneously, but in that case one dummy will most likely be treated along with the samples since three pieces tend to be more geometrical stable than two pieces.

Figure 3:
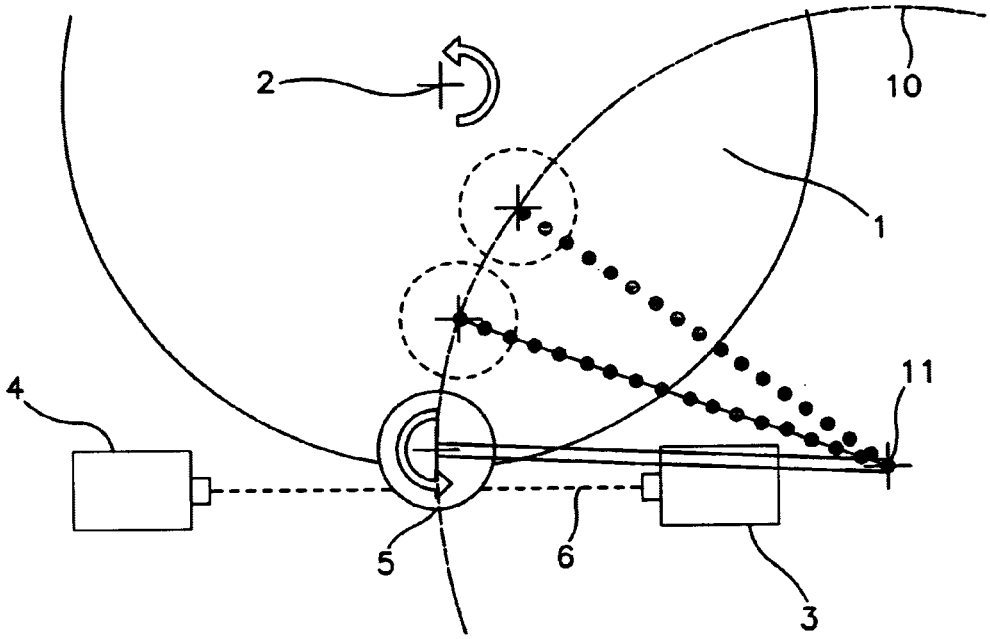
FIG. 3 shows top-view of another embodiment with single sample holder and semi-circular sweeping.

In FIG. 3 another preferred embodiment for the sweeping of the sample is shown. Here, the sample in the sample holder (5) is moved along a fraction of a circular path (10) with centre (11) outside the polishing or grinding pad by a moving device. This path takes the sample between near the centre of the polishing or grinding pad to partly over the rim of the polishing or grinding pad.

Sweeping of the sample with the moving device serves several causes. Primarily, it levels out the wear of the polishing pad, thereby yielding a more cost-effective preparation. Secondly, the sweeping reduces formation of half moon shape—an edge effects on the sample. Moreover, the sweeping facilitates a more even scratch pattern.

Figure 4A:
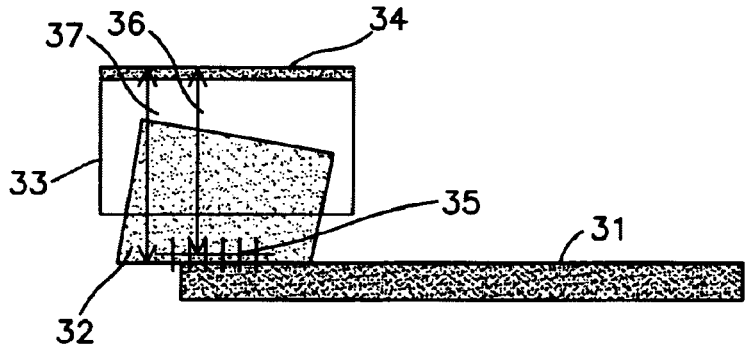
FIG. 4 shows side-view of set-up.
Figure 4B:
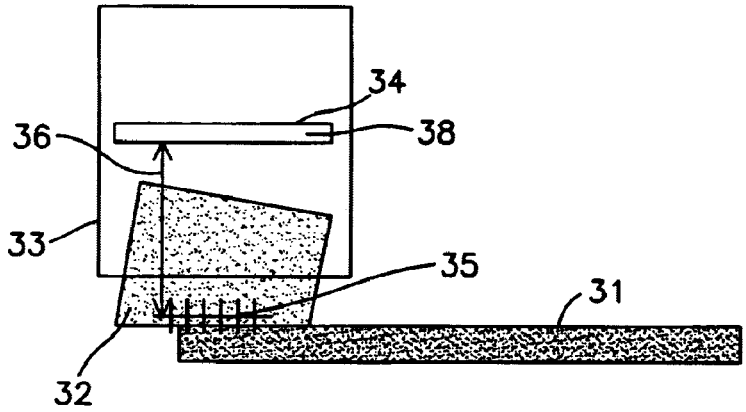

In FIG. 4 the principle of the measurement is shown. The sample (32) is placed in the sample holder (33) and the combined sample and sample holder is placed on the polishing pad. FIGS. 4A and 4B both show the sample during the measurement when the sample is over the rim of the polishing or grinding pad. The target of the polishing is inside the sample. The target may be a point, a line or a plane. In FIG. 4A the target is a line (35).

Prior to the grinding or polishing the sample must be aligned in the sample holder with respect to the reference plane (34) of the sample holder. If the target is a point, this alignment is not necessary, whereas if the target is a line or a plane, the sample should be aligned 3 dimensionally to ensure that the target is parallel to the reference plane of the sample holder. After the alignment the distance from the reference plane to the target must be established (36). The alignment and establishing of the distance 36 may be performed in an alignment station facilitated by for example microscope, video or (in case of a hidden target) X-ray equipment.

During the grinding or polishing the distance from the reference plane to the face of the sample being polished is measured inline with the material removal mechanism. This mechanism is preferably a laser scanning micrometer applied tangentially to the polishing pad. The laser scanning micrometer measures the distance (37) from the reference plane to the face of the sample being polished or grinded. The polishing or grinding is continued until the distance 37 is equal to the distance 36.

In FIG. 4B another preferred sample holder is shown. This sample holder has a built-in slit (38) which is used as a reference plane.

The set-up shown in FIGS. 4A and 4B with the polishing pad under the sample is the typical set-up for preparation of materialographic samples but the upside down set-up—typically used in the wafer industry—or the 90° turned set-up (with a vertical polishing plane)—used in some high precision applications—may likewise be used.

Figure 5A:
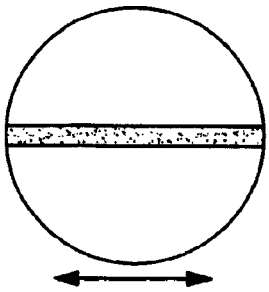
FIG. 5 shows examples of top reference planes.
Figure 5B:
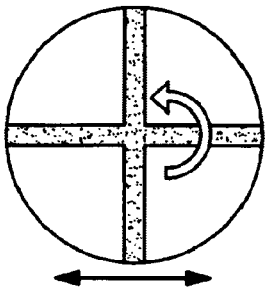
Figure 5C:
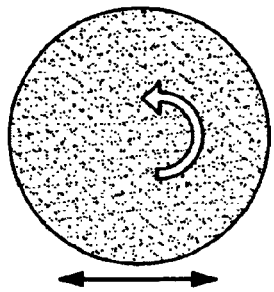

In FIG. 5 various examples of reference planes are shown. In FIG. 5A, the reference plane is a line. The line may consist of a sharp edge or a rod. The sharp edge is easier to manufacture but the rod is less sensitive to wear and misuse of the sample holder. A sample holder with just one sharp edge is most suited for a set-up where the sample swept radially or along a fraction of a line but not rotated round the axis of the sample centre. In FIG. 5B, a sample holder has two crossing lines. These lines may likewise for example be sharp edges or rods. In FIG. 5B, a sample holder with two crossing lines is shown but sample holders with more crossing lines are also feasible. In FIG. 5C, the reference plane is a flat top. This type of sample holder is easy to manufacture and is clean, however, with such a sample holder the reference plane may be hard to realign if disturbed.

The reference planes described in FIGS. 5A, 5B and 5C is only to be considered as examples of embodiments of the reference plane and not as a complete list of ways to form a reference plane on the sample holder.

Figure 6:
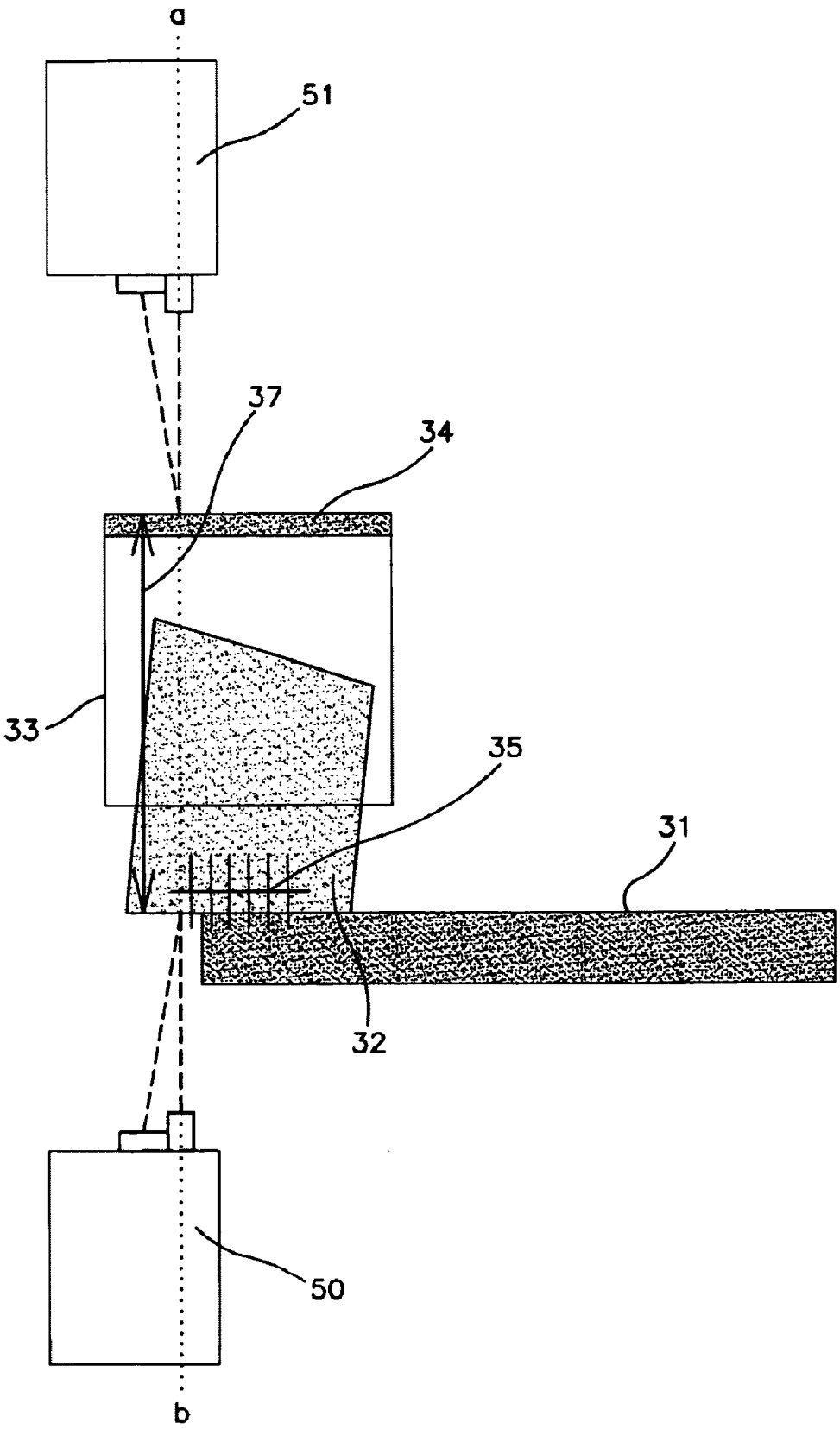
FIG. 6 shows the set-up using two displacement sensors.

In FIG. 6 an example of a set-up using two laser displacement sensors is shown. The laser displacement sensors (50) and (51) are aligned to reduce the sensitivity towards vibration and tilting of the sample holder. In FIG. 6 the laser displacement sensors are aligned along an imaginary line a-b. The distance (37) between the reference mark (34) and the plane defined by the bottom surface of the sample may now be measured for example by the triangulation measurement system by the laser displacement sensors.

For this embodiment of the invention the reference mark is preferably a plane surface parallel to the polishing pad. The reference mark may for example be the top of the sample holder or the top of the sample.

FIG. 7 is discussed in example 1.

Figure 8A:
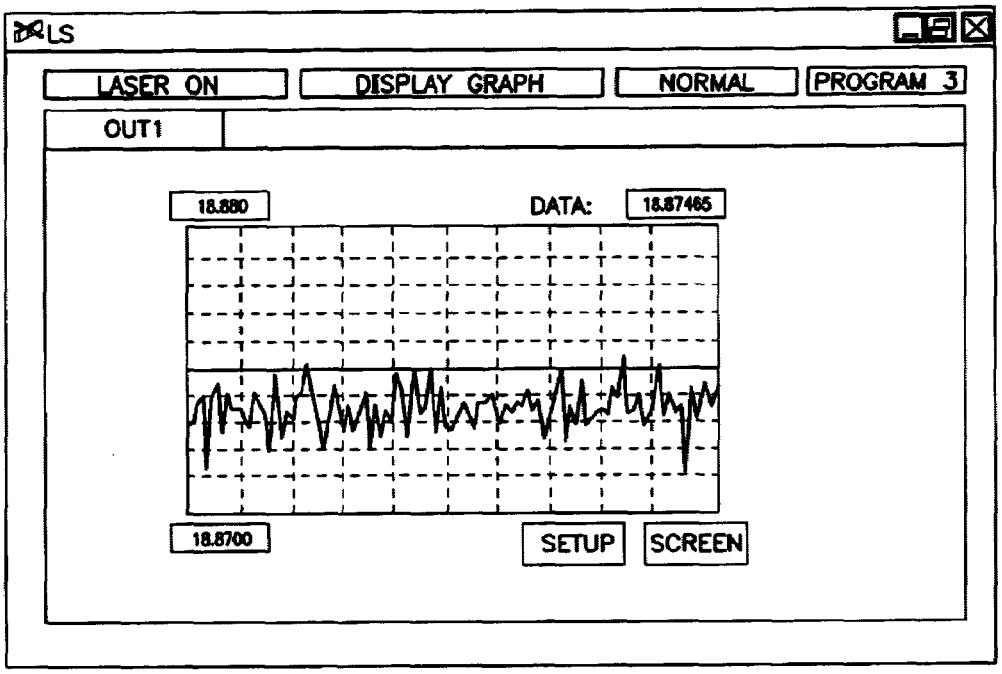
FIG. 8 shows screen prints from sensitivity test.
Figure 8B:
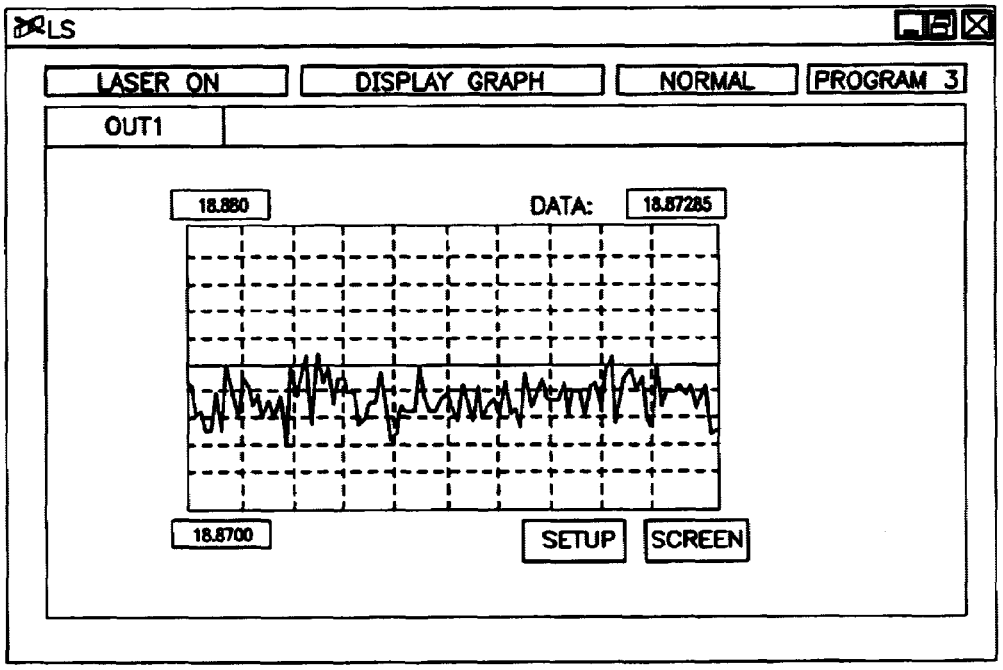

FIG. 8 is discussed in example 2.

FIG. 9 shows a side view of another embodiment with a single sample holder and a two-step measuring process. The sample holder 33 with the sample 32 mounted in it are shown in the detection position, i.e., the bottom surface 91 of the sample is positioned partially or completely over the rim of the polishing or grinding pad (not explicitly shown in FIG. 9), thereby allowing a detection from below the sample without the polishing or grinding pad obstructing any laser beam directed to the sample and/or sample holder from below as described in the following.

Figure 10:
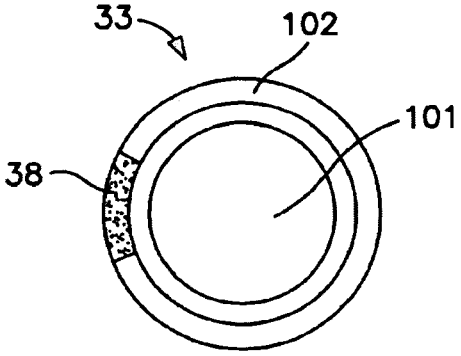
FIG. 10 shows a bottom view of a sample holder with a reference mark.

For this embodiment, a sample holder having a reference mark 38 that defines a reference plane 34 facing downwards is preferred. An example of such a sample holder is shown in FIG. 10.

The measurement is performed by a laser displacement sensor 50, e.g. the CCD laser displacement sensor LK 036 of the LK series from Keyence Corporation, Japan. The laser displacement sensor 50 comprises a laser 92 for directing a laser beam onto the surface to which the distance is to be measured, and a CCD 93 for detecting the reflected laser beam reflected from the surface. The laser displacement sensor further comprises a processor (95) for determining the distance from the sensor to the surface using triangulation.

In the embodiment of FIG. 9, the sample holder 33 is positioned above the laser displacement sensor 50 such that the detection beam is directed to the reference mark and the bottom surface, respectively, from below.

Figure 9A:
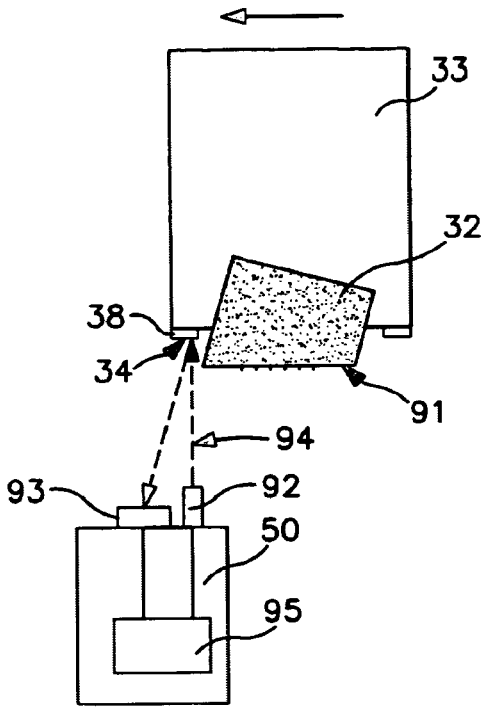
FIG. 9 shows a side view of another embodiment with single sample holder and a two-step measuring process.
Figure 9B:
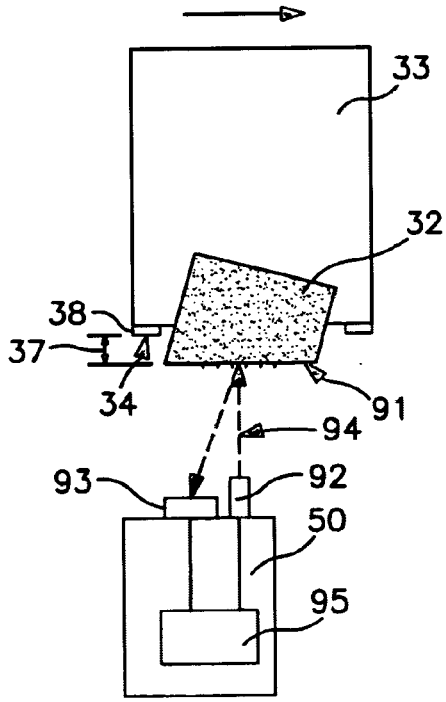

In order to measure the distance from the reference plane 34 of the reference mark 38 to the bottom surface 91 of the sample 32, the sample is first positioned relative to the laser displacement sensor such that the laser beam 94 is directed to the reference surface 34 as shown in FIG. 9*a*. Once the distance between the sensor and the reference mark is established, the sample holder is slightly repositioned to allow the probe beam to be directed to the bottom surface of the sample as shown in FIG. 9*b*, thereby allowing the measurement of the distance between the bottom surface of the sample and the sensor.

The distance 37 between the reference surface 34 and the bottom surface 91 may then be determined as the difference between the two distances.

Hence, in this embodiment, only one distance sensor is required, while still allowing an automatic inline measurement between the individual steps of the grinding/polishing process. Consequently, in this embodiment a calibration of multiple sensors with respect to each other is not required.

It is understood that the relative repositioning between the two measuring steps may be achieved by repositioning the sample holder or by repositioning the sensor. It is further understood that the order of the two measurements may be reversed.

FIG. 10 shows a bottom view of a sample holder with a reference mark. The sample holder 33 has a recess 101 for holding the sample, the recess being surrounded by an edge or rim 102. The reference mark is a polished area or spot 38 on the edge or rim. In some embodiments the reference mark may be recessed in order to protect the mark from being damaged, e.g., during mounting or removal of a sample.

FIG. 11 schematically shows a side view of a setup with a separate measurement station, cleaning station and drying station. The setup comprises a polishing pad 31 rotably mounted on a shaft 1101 and driven by a motor 1102. The sample holder 33 with sample 32 is suspended from a support structure 1103 by a positioning device 1104 for positioning the sample holder over the polishing pad and to hold the bottom surface 91 of the sample in contact with the polishing pad during the grinding/polishing step, as shown in FIG. 11*a*. The positioning device is controlled by a control unit 1106, e.g., a computer connected to the setup.

Figure 11A:
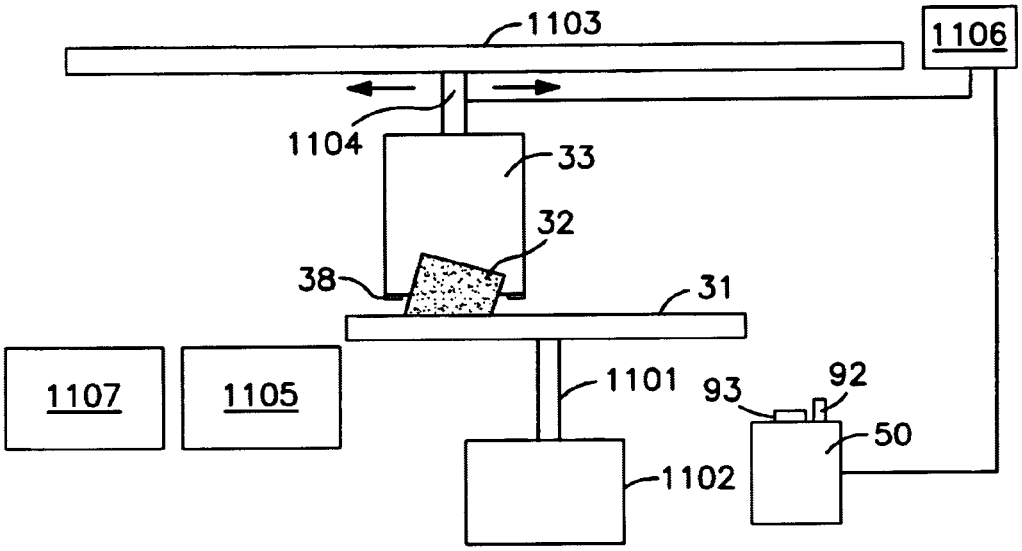
FIG. 11 shows a side view of a setup with a separate measurement station, cleaning station and drying station.
Figure 11B:
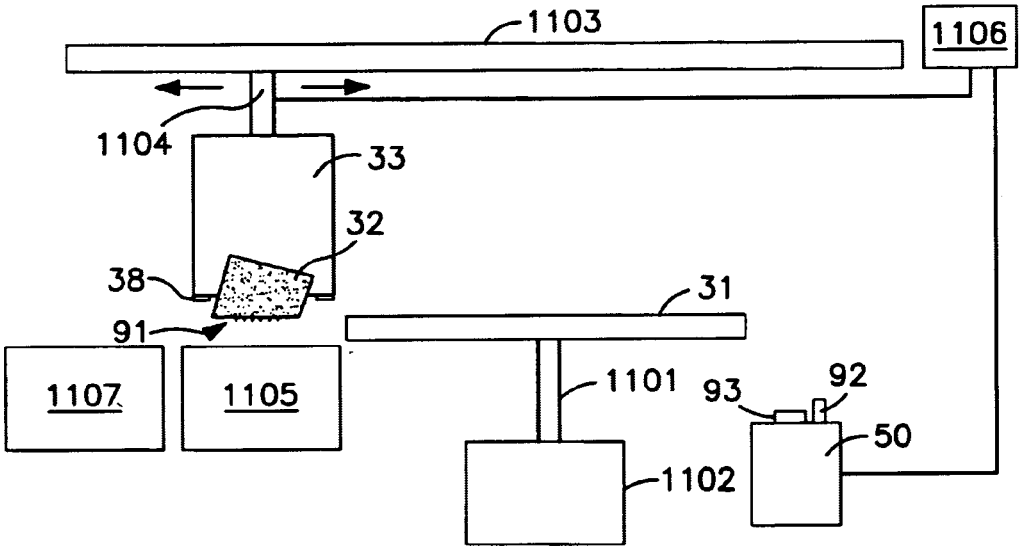
Figure 11C:
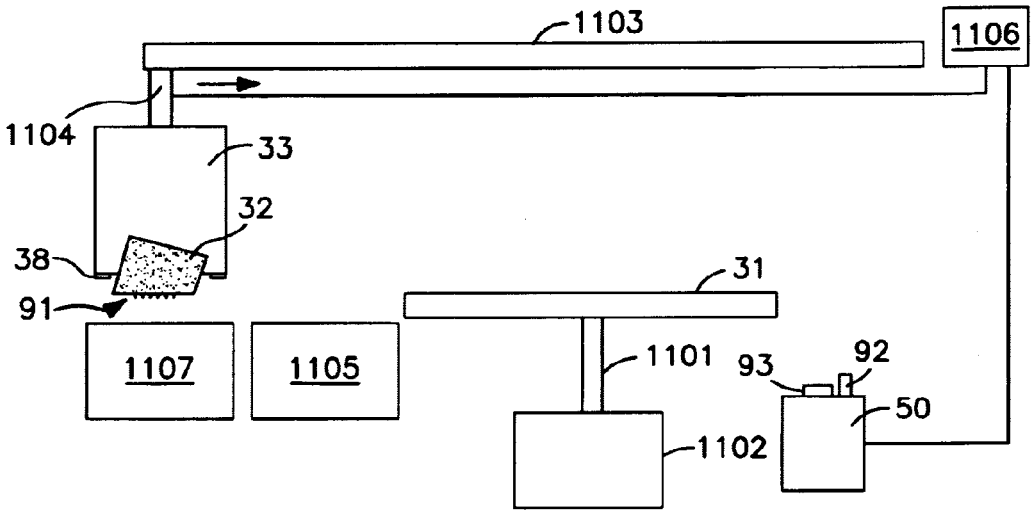

The positioning device is further arranged to move the sample holder away from the polishing pad and to a cleaning station 1105 where the sample is cleaned, e.g. by spraying the sample with water or another cleaning fluid, thereby removing any material or slurry left on the bottom surface during the grinding/polishing. FIG. 11*b* shows the setup with the sample holder positioned at the cleaning station. The setup preferably further comprises a drying station 1107, and the positioning device is further arranged to position the sample holder at the drying station after the sample has been cleaned at the cleaning station, as illustrated in FIG. 11*c*. For example, the drying station may comprise a ventilator and a heating device for blowing heated air over the sample in order to remove any remaining drops of the cleaning fluid and or any lubricant used during grinding and polishing. It is understood that the cleaning and drying stations may be combined in a single cleaning and drying station. The positioning device may comprise any suitable mechanism for positioning the sample holder, e.g., an arm that can be pivoted into different positions.

Figure 11D:
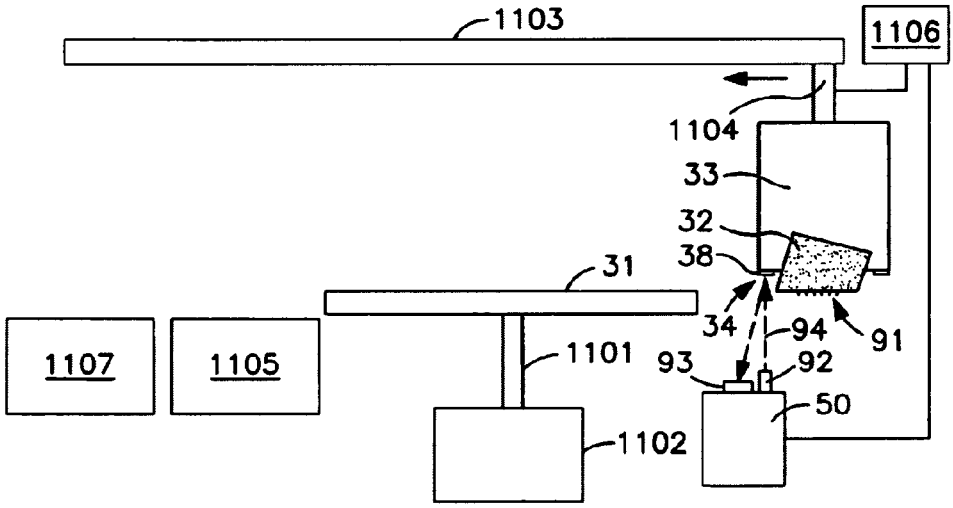

After the cleaning and drying steps, the positioning device positions the sample holder over the laser displacement sensor 50 for measuring the distance between the reference mark and the bottom surface of the sample as described above. FIG. 11*d* shows the setup with the sample holder positioned over the measuring device during the measuring step in which the distance to the reference mark 38 is determined, as described in connection with FIG. 9. Since the sample holder is not in contact with the grinding/polishing pad during the measurement, disturbances of the measurement due to vibrations etc. are avoided. The laser displacement sensor is connected to the control unit 1106 and feeds the measured distance to the control unit. It is understood that the calculation of the distance as a difference between the distance from the sensor to the reference mark and the distance from the sensor to the bottom surface may be performed by the laser displacement sensor or by the control unit.

Hence, in this embodiment, the grinding or polishing process comprises one or more grinding/polishing steps. Preferably, after each grinding/polishing step, the sample is cleaned and/or dried to improve the accuracy of the subsequent distance measurement. After the cleaning and/or drying step, the current distance between the reference mark and the bottom surface is measured and the control unit compares the distance with a reference distance stored in the control unit.

As described above, the establishing of the reference distance may be performed in an alignment station facilitated by for example microscope, video or (in case of a hidden target) X-ray equipment.

From the comparison, the control unit determines whether another polishing/grinding step is required and how long the subsequent grinding/polishing step should be.

Furthermore, the control unit may request the operator to exchange the grinding/polishing material, e.g., in order to initiate a subsequent stage of the process.

Typically, a grinding/polishing process comprises a number of individual steps, e.g., different grinding steps with different grain sizes of the grinding pad followed by one or more polishing steps. Between these steps, the grinding/polishing material on the grinding/polishing pad needs to be replaced. Hence, the breaks between the individual steps may be utilized for distance measurements.

It is a further advantage that the apparatus and process described herein may also be applied to samples that comprise a plurality of materials, inhomogeneities or the like, and to samples having unknown properties, e.g., an unknown refractive index.

EXAMPLES

Example 1

Optimization of Self-timing Parameters

To prove the feasibility of the invention an experimental set-up consisting of a rebuilt Labopol-6, Struers and a laser scanning micrometer (LS-5041, Keyence) was built. The LS-5041 was connected to a personal computer by RS-232 and controlled by a LS-5001 unit via the standard controller software from Keyence. The LS-5041 was run in self-timing mode during this experiment.

Figure 7A:
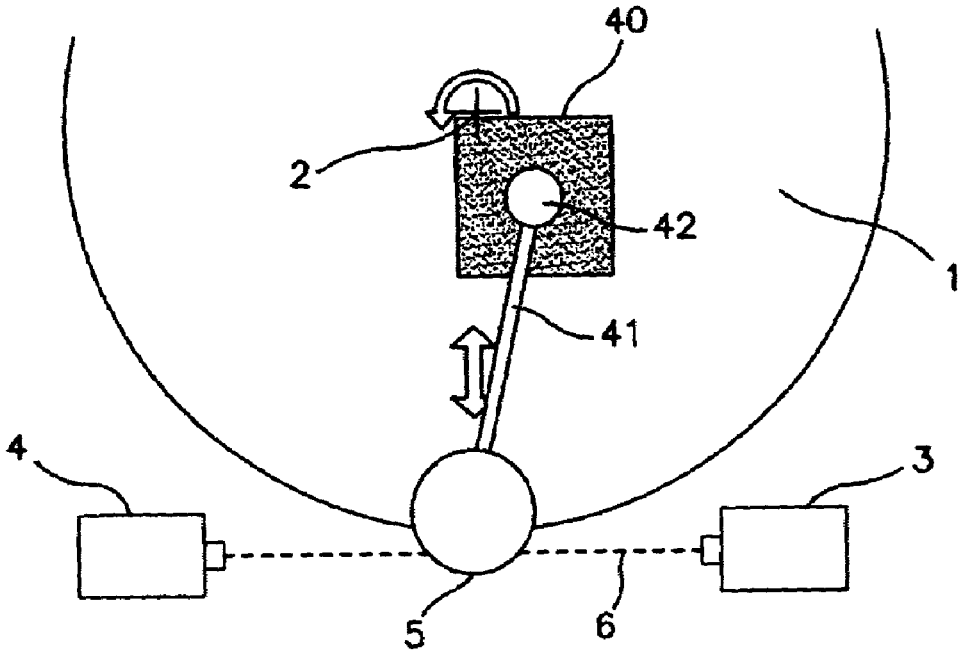
FIG. 7 shows a sketch of the set-up for the feasibility test.
Figure 7B:
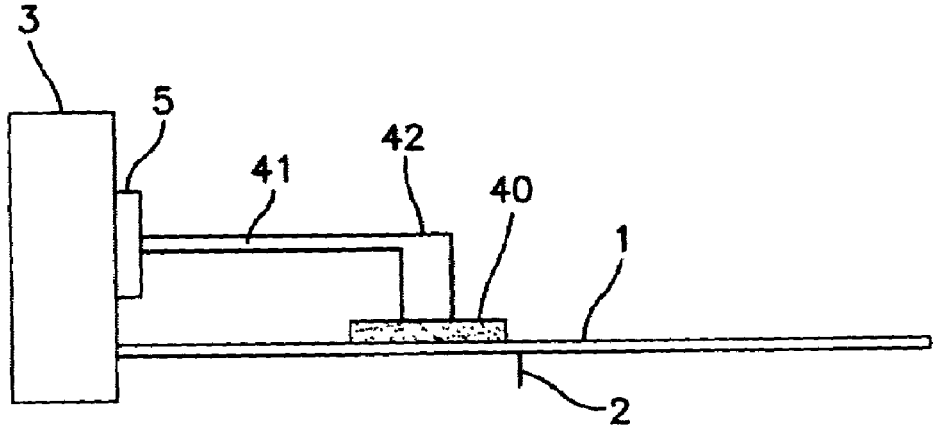

To simulate the polishing situation the set-up sketched in FIG. 7 was deployed. In FIG. 7A the set-up is seen from the top. The test sample (5) was a steel cylinder on the end of a moving arm (41). The moving arm was connected to a metal foot (40) by a rotatable metal cylinder (42). In FIG. 7B the same set-up is seen from the side. The laser receiver and the laser beam ((4) and (6), respectively, in e.g. FIG. 7A) are hidden behind the laser emitter (3).

The pause from the laser beam lattice was broken until the beginning of the measurement was varied between 100–600 ms and the measurement time was varied between 1–30 ms.

The optimum self-timing parameters for the investigated set-up was a pause of 500 ms after the laser beam lattice was broken followed by averaging for 20 ms. With these parameters the standard deviation for 20 measurements cycles was 1.1 $\mu$m.

The optimum self-timing parameters depend on the sample diameter, and the nature of the sweeping. However, reasonably standard parameters may be pre-programmed.

Example 2

Sensitivity Towards Mechanical Vibration of the Experimental Set-up

The sensitivity towards mechanical vibration of the system is crucial for the feasibility of the system since it is an inline system.

The sensitivity towards mechanical vibration of the system was tested using a LS-5041, Keyence, placed on a Labopol-6, Struers. A steel cylinder with parallel end faces was placed in the measuring field of the LS-5041. The sample height was measured with the Labopol-6 deactivated and with the Labopol-6 running with 100 rpm.

The LS-5041 was run in normal mode meaning that the height of the cylinder was measured continuously.

In FIG. 8 screen prints of the results are shown. The results show that the measured height of the sample is 18.873 mm (without vibration, FIG. 7A) and 18.874 mm (with vibration, FIG. 7B), respectively. In both cases the measurement varies approximately ±2 $\mu$m. It is noted that the measured height does not vary significantly. Furthermore, the variation between the highest and the lowest measurement is not increased in the case where the Labopol-6 vibrates the LS-5041 and the sample mechanically. In other words, the system is not influenced by a moderate mechanical vibration which will exist during an inline measurement.

Example 3

Sensitivity of Measurement Towards Water

Grinding processes are often cooled by excessive amounts of water. The sensitivity towards both airborne water droplets as well as drops of water on the laser transducer and receiver window was therefore investigated.

The LS-5041 may be programmed to take into account only bulk items and airborne water droplets which obstruct the laser beam and will therefore not in general contribute to the measured height. If a droplet by chance is placed immediately above or below the shadow of the sample, it will contribute to the measured height but since the result to be carried to the controller will be an average over time the contribution from a droplet drifting in the air will not be significant for moderate amounts of water droplets.

Drops of water on the laser glass will act as an optical lens and hence divert the direction of the monochromatic laser beam. Since the laser receiver will only accept beams coming in a straight line from the laser transmitter a water drop on the glass will act as an obstruction for the laser beam and hence influence the measurement. This problem may easily be overcome by mounting a splash shield in front of the laser transmitter and receiver.

What is claimed is:

1. An apparatus for measuring material removal during a polishing or grinding process, said apparatus comprising:

a. a substantially circular rotatable grinding or polishing pad; and b. a sample holder for holding a sample, the sample having a top surface, a bottom surface and one or more side surfaces;

wherein the sample holder is arranged to hold the bottom surface of the sample in contact with the grinding or polishing pad; the sample holder being connected to a moving device to move the sample to a position at least partially over the rim of the grinding or polishing pad during at least a part of the grinding or polishing process; and wherein the sample holder comprises a reference mark; said apparatus further comprising a detecting device for sampling, at the position at least partially over the rim of the grinding or polishing pad, the distance between the reference mark and a plane defined by the bottom surface of the sample during the process; and said detecting device is connected to a device for storing and/or comparing said distance with a stored reference distance between the reference mark and a target area in the sample.

2. An apparatus according to claim 1 wherein the reference mark is constituted by a point, a line substantially parallel to the surface of the grinding or polishing pad, an orifice substantially parallel to the surface of the grinding or polishing pad, a plane substantially parallel to the surface of the grinding or polishing pad, preferably said reference mark is placed on or in connection with the sample and/or the sample holder.

3. An apparatus according to claim 1 wherein the target area is constituted by a plane, a line, a spot/mark/point.

4. An apparatus according to claim 1 wherein the detecting device to detect the distance between the reference mark and a plane defined by the bottom surface of the sample is a scanning laser micrometer or a combination of two laser displacement sensors.

5. An apparatus according to claim 1 wherein the sample diameter is at least 20 mm.

6. An apparatus according to claim 5, wherein said sample diameter is 25 to 50 mm.

7. An apparatus according to claim 1 wherein the sample holder comprises a goniometric mechanism for three-dimensional adjustment of the sample prior to the polishing or grinding process.

8. An apparatus according to claim 1 wherein apparatus further comprises a moving device for moving or sliding the sample holder over the surface of grinding or polishing pad, said moving device is connected to the sample holder and capable of moving or sliding the sample holder in a desired pattern.

9. An apparatus according to claim 1 wherein the sample holder is adapted to contain more than one sample.

10. An apparatus according to claim 9, wherein said sample holder contains 3 to 12 samples.

11. An apparatus according to claim 1 wherein the device for storing and/or comparing the measured or detected distance during the grinding or polishing process is a computer.

12. An apparatus according to claim 1 wherein the detecting device to detect the distance between the reference mark and a plane defined by the bottom surface of the sample comprises a laser displacement sensor.

13. A method of preparing a materialographic sample, the method comprising placing the materialoaraphic sample in a sample holder, the sample holder comprising a reference mark;

bringing a bottom surface of the materialoaraphic sample in contact with a grinding or polishing pad;

positioning the materialoaraphic sample at least partially over a rim of the grinding or polishing pad during at least a part of a grinding or polishing process;

detecting, at the position at least partially over the rim of the grinding or polishing pad, a distance between the reference mark and a plane defined by the bottom surface of the materialographic sample during the grinding or polishing process; and performing at least one of storing said distance and comparing said distance with a stored reference distance between the reference mark and a target area in the materialographic sample.

14. A method of polishing a wafer, the method comprising placing the wafer in a sample holder, the sample holder comprising a reference mark;

bringing a bottom surface of the wafer in contact with a polishing pad;

positioning the wafer at least partially over a rim of the polishing pad, during at least a part of a polishing process;

detecting, at the position at least partially over the rim of the polishing pad, a distance between the reference mark and a plane defined by the bottom surface of the wafer during the polishing process; and performing at least one of storing said distance and comparing said distance with a stored reference distance between the reference mark and a target area in the wafer.

15. A method for grinding or polishing a sample or silicon wafer on a substantially circular rotating grinding or polishing pad, which method comprises the steps of:

i. selecting an area of interest in the raw material to form the sample ii. optionally resizing the raw material for example by cutting iii. optionally mounting the raw material in a resin and cure the resin to form a sample with a top surface, a bottom surface and at least one side surface, in which said an area of interest is substantially within an area near the bottom surface iv. placing the sample in a sample holder v. identifying a reference mark vi. identifying a target area in the sample vii. aligning the target area in the sample in three dimensions with respect to the reference mark when the target area is a line or plane viii. measuring the reference distance from the target area in the sample to the reference mark and storing the said reference distance in a storing device ix. placing the sample holder with the sample on a grinding or polishing pad, with the bottom surface of the sample in contact with the surface of the grinding or polishing pad x. optionally grinding or polishing the bottom surface of the sample in at least one step removing material in an amount to bring the bottom surface of the sample near to the target area in the sample xi. grinding or polishing the bottom surface of the sample until the plane defined by the bottom surface is congruent/coincident with the target area while controlling the removal of material by measuring the distance between the plane defined by the bottom surface and the reference mark and comparing the measured distance with the stored reference distance xii. stopping the grinding or polishing of the bottom surface when the distance between the plane defined by the bottom surface and the reference mark is equal to the stored reference distance.

16. A method according to claim 15 wherein a planar surface substantially parallel to the surface of the grinding or polishing pad is used as reference mark, said planar surface being the upper part of the sample and/or the sample holder.

17. A method according to claim 15 wherein more samples are placed in the sample holder and ground or polished simultaneously.

18. A method according to claim 17, wherein 3 to 12 samples are placed in the sample holder.

19. A method according to claim 15 wherein the distance between the plane defined by the bottom surface and the reference mark is measured at a position where the sample is moved with the sample holder to be at least partly over the rim of the grinding or polishing pad.

20. A method according to claim 15 wherein the distance between the plane defined by the bottom surface of the sample and the reference mark is measured with a scanning laser micrometer or a combination of two laser displacement sensors.

21. A method according to claim 15 wherein the reference distance is stored and compared to the distance measured between the plane defined by the bottom surface of the sample and the reference mark in a computer.

22. A method according to claim 15 wherein the sample is a material graphic sample.

23. A method according to claim 15 wherein the sample is a silicon wafer.

24. An apparatus for measurement of material removal during a polishing or grinding process, said apparatus comprising:

a. a rotatable grinding or polishing pad having a rim;

b. a sample holder arranged to hold a sample with a top surface, a bottom surface and one or more side surfaces, the sample holder being arranged to hold the bottom surface of the sample during at least a part of the or grinding process in contact with the grinding or polishing pad; and wherein the sample holder comprises a reference mark;

c. a moving device connected to the sample holder, wherein the moving device is adapted to position the sample holder during at least a part of the polishing or grinding process at a position at least partially over the rim of the grinding or polishing pad;

d. a detecting device for sampling, at the position at least partially over the rim of the grinding or polishing pad, the distance between the reference mark and a plane defined by the bottom surface of the sample during the process; and e. a control device connected to the detecting device for comparing said distance with a reference distance between the reference mark and a target area in the sample.

25. An apparatus according to claim 24 further comprising a detecting device for measuring the reference distance between the reference mark and a target area in the sample;

and wherein the control device comprises a storage device for storing the measured reference distance.

26. An apparatus comprising a cleaning according to claim 24, further comprising a cleaning station for cleaning the sample; and wherein the moving device is arranged to position the sample in operational contact with the cleaning station before positioning the sample at said position at least partially over the rim of the grinding or polishing pad.

27. An apparatus according to claim 26, further comprising a drying station for drying the sample; and wherein the moving device is arranged to position the sample in operational contact with the drying station before positioning the sample at said position at least partially over the rim of the grinding or polishing pad.

* * * * *